US011698074B2

(12) United States Patent
Kim et al.

(10) Patent No.: US 11,698,074 B2
(45) Date of Patent: Jul. 11, 2023

(54) TURBO COMPRESSOR AND TURBO CHILLER INCLUDING THE SAME

(71) Applicant: LG ELECTRONICS INC., Seoul (KR)

(72) Inventors: Cheolmin Kim, Seoul (KR); Jinhee Jeong, Seoul (KR); Hyunwook Han, Seoul (KR); Uisik Hwang, Seoul (KR); Jungho Kang, Seoul (KR); Heewoong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 240 days.

(21) Appl. No.: 16/921,081

(22) Filed: Jul. 6, 2020

(65) Prior Publication Data

US 2021/0348615 A1 Nov. 11, 2021

(30) Foreign Application Priority Data

May 8, 2020 (KR) ..... 10-2020-0055038

(51) Int. Cl.
*F04D 17/12* (2006.01)
*F25B 31/02* (2006.01)
*F04D 25/02* (2006.01)

(52) U.S. Cl.
CPC ..... *F04D 17/122* (2013.01); *F04D 25/02* (2013.01); *F25B 31/026* (2013.01); *F05B 2240/30* (2013.01)

(58) Field of Classification Search
None
See application file for complete search history.

(56) References Cited

U.S. PATENT DOCUMENTS 4,594,858 A * 6/1986 Shaw ..... F25B 5/02 62/228.3
5,600,967 A * 2/1997 Meckler ..... F25B 15/008 62/109
6,009,722 A * 1/2000 Choi ..... F04D 25/06 62/505

(Continued)

FOREIGN PATENT DOCUMENTS

CN 104929956 A 9/2015
CN 105257574 A 1/2016

(Continued)

*Primary Examiner* — Michael Lebentritt
(74) *Attorney, Agent, or Firm* — Birch, Stewart, Kolasch & Birch, LLP

(57) ABSTRACT

A turbo compressor includes a housing with a refrigerant suction hole, through which a refrigerant is introduced, at a front portion thereof, and a motor case defining an accommodation space. The accommodation space includes a rotation shaft extending in a front-rear direction and a motor that is configured to rotate the rotation shaft. A first impeller is coupled to one end of the rotation shaft and a second impeller is coupled to the other end of the rotation shaft. The first impeller is configured to primarily compress the refrigerant introduced into the refrigerant suction hole. A connection passage, that surrounds the motor case extends backward from an outlet of the first impeller. The second impeller is configured to secondarily compress the refrigerant introduced through the connection passage.

17 Claims, 4 Drawing Sheets

(56) References Cited

U.S. PATENT DOCUMENTS 6,012,897 A * 1/2000 Sabnis ..... F04D 27/02 415/68
2003/0059315 A1* 3/2003 Choi ..... F04D 29/0513 417/371
2003/0113215 A1* 6/2003 Choi ..... F04D 27/0292 417/279
2007/0228847 A1* 10/2007 Kim ..... H02K 9/06 310/156.28
2008/0193314 A1* 8/2008 Cho ..... F04C 18/3564 418/58
2009/0205360 A1* 8/2009 Haley ..... F04D 29/441 417/423.1
2013/0133359 A1* 5/2013 Ueda ..... F25B 31/004 62/468
2014/0150490 A1* 6/2014 Kang ..... F25B 1/053 165/104.21
2015/0008771 A1* 1/2015 Lee ..... F04D 25/0606 310/62
2015/0267709 A1 9/2015 Hoshino et al.
2017/0146271 A1 5/2017 Hasegawa et al.
2017/0260987 A1* 9/2017 Onodera ..... F04D 29/685
2017/0268806 A1* 9/2017 Knopp ..... H02K 9/19
2017/0336106 A1 11/2017 Morgan
2019/0041100 A1* 2/2019 Miyoshi ..... F28D 7/1669
2019/0048893 A1 2/2019 Kim
2019/0285085 A1* 9/2019 Cousins ..... F04D 17/06
2020/0400160 A1* 12/2020 Bae ..... F04D 25/06
2021/0010719 A1* 1/2021 Hasegawa ..... F04D 25/06
2021/0123444 A1* 4/2021 Joly ..... F04D 29/444
2021/0172458 A1* 6/2021 Oh ..... F04D 29/582
2021/0324876 A1* 10/2021 Lee ..... F04D 29/444

FOREIGN PATENT DOCUMENTS

CN 108713100 A 10/2018
CN 109072928 A 12/2018
KR 20010063916 * 7/2001
KR 20010064028 * 7/2001
KR 10-2011-0109090 A 10/2011

* cited by examiner

TURBO COMPRESSOR AND TURBO CHILLER INCLUDING THE SAME

CROSS-REFERENCE TO RELATED APPLICATIONS

The present application claims priority under 35 U.S.C. 119 and 35 U.S.C. 365 to Korean Patent Application No. 10-2020-0055038 (filed on May 8, 2020), which is hereby incorporated by reference in its entirety.

BACKGROUND

The present disclosure relates to a turbo compressor and a turbo chiller including the same.

Generally, a turbo chiller may include a refrigeration cycle. That is, the turbo chiller may include a turbo compressor that suctions a low-pressure refrigerant to compress the low-pressure refrigerant into a high-pressure refrigerant, a condenser in which the compressed refrigerant is condensed, an expansion device that expands the refrigerant passing through the condenser, and an evaporator that evaporates the refrigerant expanded in the expansion device.

The turbo compressor may include a centrifugal compressor. In addition, the turbo compressor may function to discharge a gas in a high-pressure state while converting kinetic energy generated by a driving motor into a positive pressure.

In detail, the turbo compressor may include an impeller that rotates by driving force of the driving motor to compress the refrigerant, a diffuser, and a housing in which the impeller is accommodated.

Here, the impeller may be provided with a plurality of impellers. For example, the impeller may be provided as a two-stage centrifugal impeller. Since the two-stage centrifugal impeller performs centrifugal compression in two stages, compression efficiency may be improved compared to a case in which the centrifugal compression is performed in one stage.

The impeller may be divided into a centrifugal impeller, a mixed flow impeller, and an axial flow impeller. Here, the impeller has a relationship in which a specific speed range is limited according to the shape, and a specific diameter increases as the specific speed decreases.

In detail, the centrifugal impeller has relatively the smallest number of revolutions and the largest impeller size, and the axial flow impeller has relatively the largest number of revolutions and the smallest impeller size. The mixed flow impeller may have a range between the centrifugal impeller and the axial flow impeller.

That is, the turbo compressor according to the related art, which is provided with the two-stage centrifugal impeller has a limitation the impeller increases in size because there is a limiting range due to an increase in the number of revolutions. In detail, the turbo compressor according to the related art has a limitation in that the impeller has to increase in size (or diameter) because a specific speed design range of the centrifugal impeller has to be selected to be about 1.1 or less.

Also, in the turbo compressor according to the related art, which is provided with the two-stage centrifugal impeller, an outlet of a first impeller that performs first centrifugal compression (one stage) and an outlet of a second impeller that performs second centrifugal compression (two stages) may be faced in the same direction, and the outlet of the first impeller may be disposed to be directly connected to the inlet of the second impeller. It may be understood that the arrangement of the two-stage centrifugal impeller is "serial continuous arrangement".

When the two-stage centrifugal impeller is continuously arranged in series, there is a limitation in that the turbo compressor increases in size because each of the first impeller and the second impeller has a circular shape. Also, since a shape of a passage connecting the first impeller to the second impeller is complicated, there is a limitation in that a pressure loss increases.

For another example, in the turbo compressor according to the related art, which is provided with the two-stage centrifugal impeller, the outlet of the first impeller and the outlet of the second impeller may be disposed to be spaced apart from each other in both side directions with respect to the driving motor. The arrangement of the two-stage centrifugal impeller may be understood as "symmetrical arrangement".

When the two-stage centrifugal impeller is symmetrically disposed, there is a limitation in that the turbo compressor more increases in size because a separate connection tube for connecting the first impeller to the second impeller is provided. In addition, due to the above-described reason, there is a problem in that the compressor increases in size because each of the first impeller and the second impeller has the circular shape.

SUMMARY

Embodiments provide a turbo compressor and a turbo chiller including the same.

Embodiments also provide a turbo compressor that is capable of improving performance while minimizing a size of the turbo compressor and a turbo chiller including the same.

Embodiments also provide a turbo compressor that is capable of minimizing a size of an impeller while improving compression performance in a multi-stage compression process and a turbo chiller including the same.

Embodiments also provide a turbo compressor that is capable of reducing a pressure loss of a refrigerant, which occurs in a multi-stage compression process, and a turbo chiller including the same.

Embodiments also provide a turbo compressor that is capable of minimizing, simplifying, or straightening a refrigerant flow between two impellers performing multi-stage compression and a turbo chiller including the same.

Embodiments also provide a turbo compressor that is capable of reducing a loss occurring in a refrigerant flow between an impeller performing initial compression and an impeller performing next compression and a turbo chiller including the same.

In one embodiment, a turbo compressor includes: a housing configured to define an outer appearance, the housing being provided with a refrigerant suction hole, through which a refrigerant is introduced, at a front portion thereof; a motor case configured to define an accommodation space in which a rotation shaft extending in a front-rear direction and a motor configured to provide driving force to the rotation shaft are installed; a first impeller coupled to one end of the rotation shaft, the first impeller being configured to primarily compress the refrigerant introduced into the refrigerant suction hole; a connection passage extending backward from an outlet of the first impeller, the connection passage being configured to surround the motor case; and a second impeller coupled to the other end of the rotation shaft, the second impeller being configured to secondarily compress the refrigerant introduced through the connection passage.

The motor case may be disposed to be spaced inward from the housing, and the connection passage may be provided in the spaced space between the housing and the motor case.

The motor case may be surrounded by the housing.

The connection passage may be provided in a space defined between an inner circumferential surface of the housing and an outer circumferential surface of the motor case.

The first impeller and the second impeller may be disposed at front and rear sides of the motor, respectively.

The outlet of the first impeller and an outlet of the second impeller may be faced in the same direction, and the first impeller and the second impeller may be disposed to be spaced apart from each other in the front-rear direction so as to be connected by the connection passage.

The first impeller may be provided as a mixed flow impeller.

The second impeller may be provided as a centrifugal impeller and has a diameter range that is equal to that of the first impeller.

The turbo compressor may further include a vane installed in the connection passage to guide a flow of the refrigerant.

The vane may extend from an outer circumferential surface of the motor case to an inner circumferential surface of the housing.

The vane may include a first vane and a second vane disposed behind the first vane.

Each of the first vane and the second vane may have an air-foil shape in the front-rear direction.

The second vane may be provided in plurality, which are disposed to be spaced apart from each other in both circumferential directions with respect to a trailing edge of the first vane.

The vane may include a wire hole through which the accommodation space of the motor case and the outside of the housing communicate with each other, and a wire configured to provide power is inserted into the wire hole.

The turbo compressor may further include a bearing and a thrust bearing, which are configured to support rotation of the rotation shaft.

The bearing may include a first bearing and a second bearing, which are disposed to be spaced apart from each other in the front-rear direction by using the rotation shaft as a central point.

The thrust bearing may be disposed between the first bearing and the first impeller.

The motor may include a permanent magnet motor, and the bearing may include a magnetic bearing configured to support the rotation shaft by using magnetic force.

The connection passage may include: a discharge channel configured to guide the refrigerant discharged from the first impeller, the discharge channel extending to have a diameter increasing backward from the outlet of the first impeller; a connection channel extending to have a constant diameter backward from the discharge channel; and an inflow channel extending to have a diameter decreasing backward from the connection channel, the inflow channel being configured to guide the refrigerant so as to be introduced into the second impeller.

The turbo compressor may further include a volute case coupled to a rear end of the housing and having a refrigerant discharge hole, wherein the refrigerant passing through the second impeller may be introduced into the refrigerant discharge hole.

In another embodiment, a turbo chiller includes: the turbo compressor; a condenser configured to heat-exchange the refrigerant compressed in the turbo compressor with cooling water; an expansion valve configured to expand the refrigerant passing through the condenser; and an evaporator configured to evaporate the refrigerant passing through the expansion valve so as to provide the expanded refrigerant to the turbo compressor.

The turbo chiller may further include: an economizer installed between the expansion valve and the evaporator; and an injection tube through which the refrigerant separated from the economizer flows.

The turbo compressor may include: an injection tube connection passage configured to communicate with the injection tube; and an injection hole defined in the housing so that the injection tube connection passage and the connection passage communicate with each other.

The details of one or more embodiments are set forth in the accompanying drawings and the description below. Other features will be apparent from the description and drawings, and from the claims.

DETAILED DESCRIPTION

Hereinafter, exemplary embodiments will be described with reference to the accompanying drawings. The disclosure may, however, be embodied in many different forms and should not be construed as being limited to the embodiments set forth herein; rather, that alternate embodiments included in other retrogressive disclosures or falling within the spirit and scope of the present disclosure will fully convey the concept of the disclosure to those skilled in the art.

Figure 1:
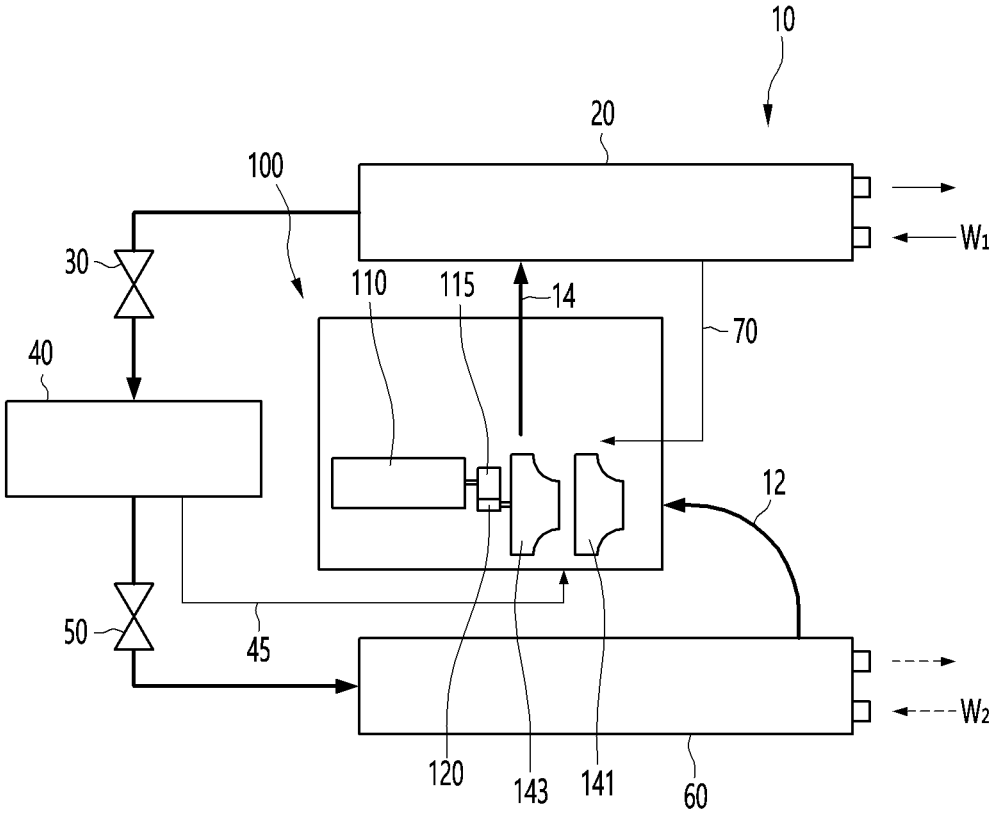
FIG. 1 is a schematic view illustrating a configuration of a turbo chiller and a flow of a refrigerant according to an embodiment.

FIG. 1 is a schematic view illustrating a configuration of a turbo chiller and a flow of a refrigerant according to an embodiment.

Referring to FIG. 1, a turbo chiller 10 according to an embodiment may include a turbo compressor 100 (hereinafter, referred to as a "compressor") that compresses a refrigerant, a condenser 20 that condenses the refrigerant compressed in the compressor 100, expansion valves 30 and 50 that decompress the refrigerant condensed in the condenser 20, and an evaporator 60 that evaporates the refrigerant decompressed in the expansion valves 30 and 50.

Also, the turbo chiller 10 may further include an economizer 40 that separates a liquid refrigerant and a gaseous refrigerant from the refrigerant decompressed through the expansion valves 30 and 50.

To increase in refrigerant compression efficiency in two stages, the gas refrigerant separated in the economizer 40 may be introduced into the compressor 100 through an injection tube 45.

In detail, the injection tube 45 may extend from the economizer 40 to an injection tube connection passage 210 (see FIG. 2) disposed at one side of the compressor 100. The refrigerant introduced into the injection tube connection passage 210 may be discharged through a connection channel 320 (see FIG. 2) provided inside the compressor 100. The refrigerant discharged from the injection tube connection passage 210 may be mixed with a primarily (or one-stage) compressed refrigerant.

The expansion valves 30 and 50 may include a first expansion valve 30 that primarily decompresses the refrigerant condensed in the condenser 20 and a second expansion valve 50 that secondarily decompresses the liquid refrigerant separated in the economizer 40.

The first expansion valve 30 or the second expansion valve 50 may include an electronic expansion valve (EEV) that is capable of being adjusted in opening degree.

The compressor 100 may include a centrifugal turbo compressor.

A suction tube 12 that guides suction of the refrigerant evaporated in the evaporator 60 may be installed at an inlet-side of the compressor 100. Also, a discharge tube 14 extending to the condenser 20 may be installed at an outlet-side of the compressor 100.

Cooling water W1 is introduced into and discharged from the condenser 20, and the cooling water is heat-exchanged with the refrigerant while passing through the condenser 20 so as to be heated.

Also, cooling water W2 is introduced into and discharged from the evaporator 60, and the cooling water is heat-exchanged with the refrigerant while passing through the evaporator 60 so as to be cooled.

The compressor 100 includes a motor 110 that generates driving force, a power transmission member 115 that transmits the driving force of the motor 110 to impellers 141 and 143, and a rotation shaft 120 connecting the power transmission member 115 to the impellers 141 and 143.

The motor 110 may include a permanent magnet (PM) motor for high-speed rotation.

The impellers 141 and 143 may include a first impeller 141 that primarily compresses the refrigerant introduced into a refrigerant suction hole 202 and a second impeller 143 that secondarily compresses the primarily compressed refrigerant.

The first impeller 141 and the second impeller 143 may be disposed in both directions with respect to the motor 110, respectively. That is, the first impeller 141 and the second impeller 143 may be disposed to be spaced apart from each other in front-rear directions with respect to the motor 110.

For example, the first impeller 141 may be disposed at a front side (or inlet-side) of the compressor 100, and the second impeller 143 may be disposed at a rear side (or outlet-side) of the compressor 100.

The refrigerant passing through the second impeller 143 may be discharged to a refrigerant discharge hole 104 (see FIG. 2) and then introduced into the discharge tube 14.

Due to the rotation of the rotation shaft 120, the first impeller 141 and the second impeller 143 may rotate together.

The compressor 100 may be provided with a refrigerant suction hole 202 (see FIG. 2) communicating with the suction tube 12. The refrigerant suction hole 202 may be coupled to the outlet-side of the suction tube 12.

Also, the turbo chiller 10 may further include a droplet supply tube 70 that supplies the refrigerant condensed in the condenser 20 to the compressor 100.

The refrigerant supplied through the droplet supply tube 70 may be in a condensed state and thus may have a liquid phase. Also, a pressure of the droplet refrigerant supplied through the droplet supply tube 70 may be greater than that of the primarily compressed refrigerant flowing through the connection channel 320 to be described later.

Figure 2:
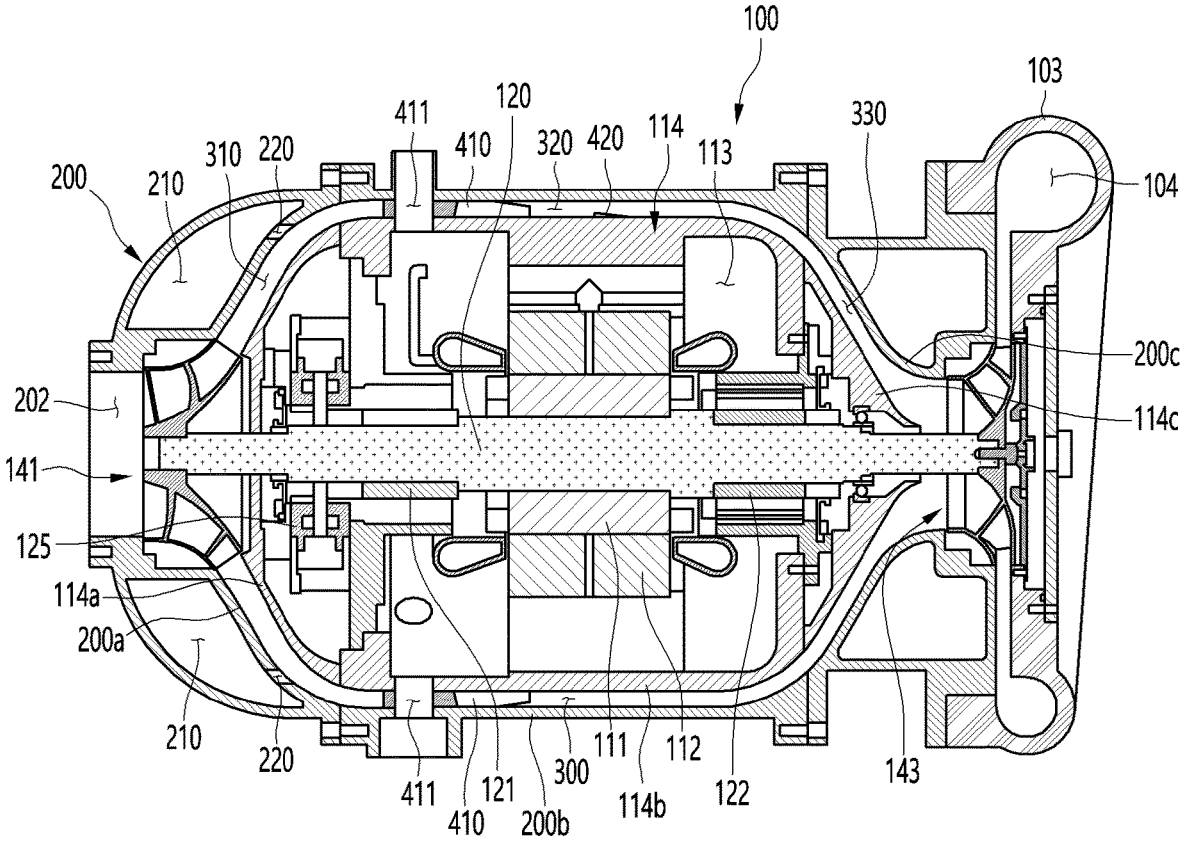
FIG. 2 is a cross-sectional view of a configuration of a turbo compressor according to an embodiment.

FIG. 2 is a cross-sectional view of a configuration of the turbo compressor according to an embodiment.

Referring to FIG. 2, the compressor 100 may further include a housing 200 provided with the refrigerant suction hole 202.

The housing 200 may define an outer appearance of the compressor 100. For example, the housing 200 may have a hollow shape of which the inside is empty. The housing 200 may have a substantially cylindrical shape.

The housing 200 may be provided with a plurality of housing parts 200*a*, 200*b*, and 200*c* coupled to each other to seal an inner space.

The plurality of housing parts 200*a*, 200*b*, and 200*c* may be coupled to each other to define the integrated outer appearance. Thus, since the housing 200 is provided to be assembled, the compressor 100 may be easily assembled and disassembled.

In detail, the housing 200 may include a first housing part 200*a* disposed at the front side, a second housing part 200*b* disposed behind the first housing part 200*a*, and a third housing part 200*c* disposed behind the second housing part 200*b*.

The first housing part 200*a* and the third housing part 200*c* may be connected to each other by the second housing part 200*b*. For example, the second housing part 200*b* may be coupled to a rear end of the first housing part 220*a* and a front end of the third housing part 220*c*.

The first housing part 200*a* may provide the injection tube connection passage 210 into which the refrigerant separated from the economizer 40 is introduced. As described above, the injection tube connection passage 210 is connected to the injection tube 45.

The injection tube connection passage 210 may be provided as a hollow extending in a circumferential direction inside the first housing part 200*a*. For example, the injection tube connection passage 210 may be understood as a space defined in a circumferential direction between an inner circumferential surface of the first housing part 200*a* facing the outer circumferential surface of a motor case 114 to be described later and an outer circumferential surface of the first housing part 200*a*.

An injection hole 220 into which the refrigerant flowing through the injection tube connection passage 210 is introduced into the connection passage to be described later may be defined in the outer circumferential surface of the motor case 114.

For example, the injection hole 220 may be punched to allow the injection tube connection passage 210 and a discharge channel 310 to be described later to communicate with each other. Thus, the refrigerant flowing through the injection tube connection passage 210 may be mixed with the refrigerant discharged from the first impeller 141 through the injection hole 220.

The refrigerant suction hole 202 may be defined in a front surface of the first housing part 200*a*, and the refrigerant suction hole 202 may extend backward from the inside of the first housing part 200*a*. That is, the refrigerant suction hole 202 may be opened in the front-rear direction and be connected to the suction tube 12 at the front end. In other words, the refrigerant suction hole 202 may be defined in an inlet (or front portion) of the housing 200.

The first impeller 141 may be disposed inside the first housing part 200*a*. That is, the first impeller 141 may be disposed in the refrigerant passage extending from the refrigerant suction hole 202.

The refrigerant suctioned into the refrigerant suction hole 202 may be primarily compressed while passing through the first impeller 141.

The second impeller 143 may be disposed inside the third housing part 200*c*.

A volute case 103 may be coupled to the rear end of the third housing part 200*c*. In this case, the volute case 103 may be provided in the refrigerant discharge hole 104.

Also, the volute case 103 may guide the refrigerant discharged in a radial direction from the second impeller 143 to the refrigerant discharge hole 104. That is, the inner space of the volute case 103 may extend to connect the outlet of the second impeller 143 to the refrigerant discharge hole 104.

The compressor 100 may further include a motor case 114 surrounded by the housing 200.

The motor case 114 may be spaced apart from the inside of the housing 200. That is, a space having a predetermined gap may be defined between the motor case 114 and the housing 200.

The motor case 114 may be provided to surround the motor 110. For example, the motor case 114 may have a substantially cylindrical shape having an accommodation space 113. The motor 110 may be installed in the accommodation space 113 of the motor case 114.

Also, the motor case 114 may be provided to be assembled or disassembled so as to correspond to the housing 200. For example, the motor case 114 may be provided with a plurality of case parts 114*a*, 114*b*, and 114*c* coupled to each other to seal the accommodation space 113.

In detail, the motor case 114 may include a first case part 114*a* disposed to correspond to the inside of the first housing part 200*a*, a second case part 114*b* coupled to a rear end of the first case part 114*a* and disposed to correspond to the inside of the second housing part 200*b*, and a third case part 114*c* coupled to a rear end of the second case part 114*b* and disposed to correspond to the inside of the third housing part 200*c*.

A rotation shaft 120 extending in the front-rear direction may be disposed in the accommodation space 113 of the motor case 114.

The rotation shaft 120 may be disposed at a center of the motor case 114. That is, the rotation shaft 120 may be understood as a central axis of the compressor 100.

The rotation shaft 120 may rotate by the driving force of the motor 110.

The first impeller 141 may be coupled to one end of the rotation shaft 120, and the second impeller 143 may be coupled to the other end of the rotation shaft 120.

For example, a front end of the rotation shaft 120 may be coupled to the first impeller 141. Also, a rear end of the rotation shaft 120 may be coupled to the second impeller 143.

Thus, the first impeller 141 and the second impeller 143 may rotate according to the rotation of the rotation shaft 120.

The motor 110 may include a rotor 111 and a stator 112, which provide the driving force. Here, the rotor 111 and the stator 112 may be provided in one pair.

The stator 112 may be coupled to the inside of the motor case 114. For example, the stator 112 may be coupled along an inner circumferential surface of the second case part 114*b*. Also, the stator 112 may extend in a circumferential direction with respect to the rotation shaft 120.

The rotor 111 may be disposed inside the stator 112 to extend in the circumferential direction so as to surround a central portion of the rotation shaft 120. For example, the rotor 111 may be coupled to the central portion of the rotation shaft 120.

Alternatively, the power transmission member 115 may further include one or more gears coupled to the motor 110 to allow the rotation shaft 120 to rotate.

Also, the power transmission member 115 may further include bearings 121 and 122 and a thrust bearing 125, which support the rotation of the rotation shaft 120.

Since the first impeller 141 and the second impeller 143 are coupled to the front end and the rear end of the rotation shaft 120, respectively, the bearings 121 and 122 may include a first bearing disposed close to the first impeller 141 and a second bearing 122 disposed close to the second impeller 143 with respect to a center or a center point of the rotation shaft 120.

That is, the first bearing 121 and the second bearing 122 may be disposed to be spaced apart from each other in the front-rear direction or both directions from the center point of the rotation shaft 120.

Since the first bearing 121 and the second bearing 122 are coupled to surround the rotation shaft 120, the position of the rotation shaft 120 may be fixed, and also, friction generated due to the rotation may be reduced.

Each of the first bearing 121 and the second bearing 122 may include a magnetic bearing that supports the rotation shaft 120 by using magnet force.

The thrust bearing 125 may be disposed between the first bearing 121 and the first impeller 141. The thrust bearing 125 may support a load acting in an axial direction of the rotation shaft 120.

The compressor 100 may further include a connection passage 300 that guides the primarily compressed refrigerant passing through the first impeller 141 to the second impeller 143.

The connection passage 300 may be provided by the housing 200 and the motor case 114. That is, the connection passage 300 may be provided as a space between the inner circumferential surface of the housing 200 and the outer circumferential surface of the motor case 114.

In other words, the housing 200 and the motor case 114 may provide a passage so that the refrigerant flows from the refrigerant suction hole 202 defined in the front portion of the compressor 100 to the refrigerant discharge hole defined in the rear portion of the compressor 100.

In other words, the connection passage 300 is provided inside the compressor 100 to surround the motor case 114.

In detail, the connection passage 300 may include a discharge channel 310 that guides the refrigerant discharged from the first impeller 141, a connection channel 320 extending backward from the discharge channel 310, and an inflow channel 330 extending backward from the connection channel 320 to guide the refrigerant so that the refrigerant is introduced into the second impeller 143.

For example, the discharge channel 310 may have a diameter that increases backward from the outlet of the first impeller 141. Also, the connection channel 320 may extend with a constant diameter toward the rear side. Also, the inflow channel 330 may have a diameter that decreases toward the rear side at which the inlet of the second impeller 143 is disposed.

Thus, since the primarily compressed refrigerant discharged from the first impeller 141 is introduced into the second impeller 143 along the connection channel 300 provided in a relatively streamlined shape, a flow loss of the refrigerant may be reduced.

The discharge channel 310 may be provided as a space defined by the outer circumferential surface of the first case part 114*a* and the inner circumferential surface of the first housing part 200*a*. In other words, the discharge channel 310 may be provided to surround the first case part 114*a* in the circumferential direction.

The injection hole 220 may extend to the discharge channel 310 to allow the refrigerant in the injection tube connection passage 210 to be introduced therein.

The connection channel 320 may be provided as a space defined by the outer circumferential surface of the second case part 114*b* and the inner circumferential surface of the second housing part 200*b*. In other words, the connection channel 320 may be provided to surround the second case part 114*b* in the circumferential direction.

The connection channel 320 may guide the refrigerant flowing through the discharge channel 310 to flow into the inflow channel 330. For example, vanes 410 and 420 to be described later may be installed in the connection channel 320. As a result, the swirl of the refrigerant passing through the connection channel 320 may be reduced.

The inflow channel 330 may be provided as a space defined by the outer circumferential surface of the third case part 114*c* and the inner circumferential surface of the third housing part 200*c*. In other words, the inflow channel 330 may be provided to surround the third case part 114*c* in the circumferential direction.

The inflow channel 330 may guide the refrigerant flowing through the connection channel 320 to the inlet of the second impeller 143.

As a result, the primarily compressed refrigerant compressed in the first impeller 141 may flow along the connection passage 300 to flow into the second impeller 143. Also, the secondarily compressed refrigerant that is additionally compressed in the second impeller 143 may be introduced into the discharge tube 14 through the refrigerant discharge hole 104 to flow into the condenser 20.

The impellers 141 and 143 according to an embodiment may be disposed in series, unlike the above-described series continuous arrangement or symmetrical arrangement.

That is, the outlet of the first impeller 141 may be connected to the connection passage 300 that surrounds an outer periphery of the motor 110 or is provided along the outer circumferential surface of the motor case 114, and the connection passage 300 may be connected to the inlet of the second impeller 143.

As a result, the directions in which the outlet of the first impeller 141 and the inlet of the second impeller 143 are directed may be the same, but the first impeller 141 and the second impeller 143 may be spaced apart from each other.

Also, the first impeller 141 may be provided as a mixed flow impeller. For example, the first impeller 141 may be provided as the mixed flow impeller, and the second impeller 143 may be provided as a centrifugal impeller.

As described above, when the first impeller 141 is provided as the mixed flow impeller, a rotation rate may increase, and a diameter (or size) may decreases when compared to the existing centrifugal impeller.

For example, the first impeller 141 may have a diameter ranging of about 300 mm to about 400 mm. Here, the second impeller 143 provided as the centrifugal impeller may have a diameter ranging of about 300 mm to about 400 mm. That is, according to an embodiment, while satisfying target performance of the compressor 100, the diameter of the first impeller 141, which is provided as the mixed flow impeller, and the diameter of the impeller 143, which is provided as the centrifugal impeller, may be designed in the same range. Therefore, the overall diameter of the compressor 100 may be reduced when compared to the case in which the first impeller is provided as the centrifugal impeller.

As a result, since the number of revolutions of the first impeller 141 is higher than that of the centrifugal impeller, the compression performance may be improved. Thus, it may be more suitable for characteristics of an eco-friendly refrigerant (e.g., R1233zd) that has been recently proposed, than a refrigerant such as the existing R-134a.

In addition, even if the first impeller 141 is provided as the mixed flow impeller, a flow of the refrigerant introduced into the second impeller 143 by the connection passage 300 may be relatively straightened. Thus, the flow loss of the refrigerant may be reduced.

In addition, the first impeller 141 may more decrease in diameter, and the compressor 100 may be more compact by the connection passage 300 surrounding the motor case 114.

Also, since the connection passage 300 surrounds the motor case 114, dew condensation caused by a temperature difference between the existing motor case and external air may be prevented.

The compressor 100 may further include a diffuser (not shown) installed on a rear surface of the second impeller 143 to compress the refrigerant discharged from the second impeller 143 in the radial direction.

For example, the diffuser may be coupled to an end of the rotation shaft 120 and be installed at a central portion of the rear surface of the second impeller 143.

The diffuser may include a diffuser vane (not shown) that protrudes forward toward the second impeller 143 and is provided in a plurality along the circumferential direction.

For example, the diffuser vane may extend in a rake shape along the radial direction. Also, the diffuser vane may compress and guide the refrigerant passing through the second impeller 143.

Figure 3:
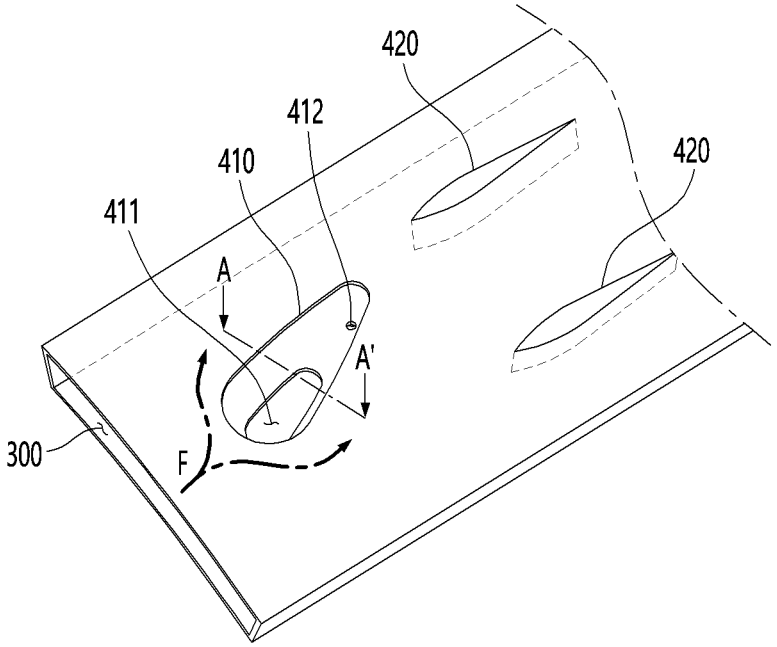
FIG. 3 is a schematic view illustrating a flow of the refrigerant in a connection passage of the turbo compressor according to an embodiment.
Figure 4:
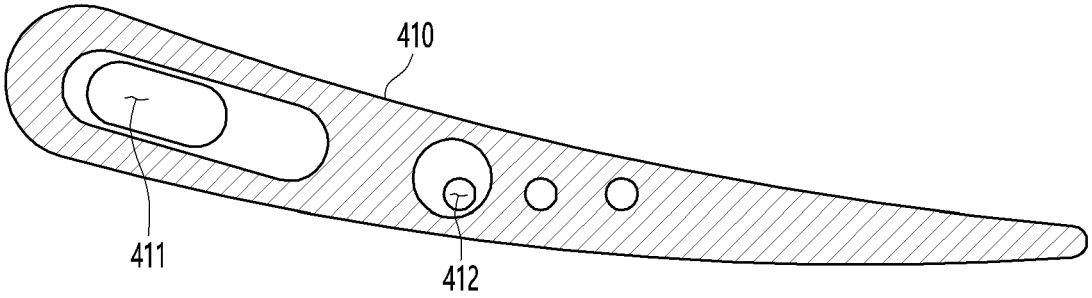
FIG. 4 is a cross-sectional view taken along line A-A' of FIG. 3.

FIG. 3 is a schematic view illustrating a flow of the refrigerant in the connection passage of the turbo compressor according to an embodiment, and FIG. 4 is a cross-sectional view taken along line A-A' of FIG. 3.

Referring to FIGS. 2 to 4, the compressor 100 may further include vanes 410 and 420 disposed in the connection passage 300.

The vanes 410 and 420 may guide the flow of the refrigerant so that the swirl of the refrigerant passing through the connection passage 300 is reduced, and the flow direction of the refrigerant is more straightened.

That is, when the first impeller 141 is provided as the mixed flow impeller, the refrigerant discharged from the first impeller 141 and introduced into the connection passage 300 may have a strong rotating component. Thus, the vanes 410 and 420 may perform a function of reducing a loss of the refrigerant flowing through the connection passage 300 and reducing the rotating flow component to allow the refrigerant to be more effectively introduced into the second impeller 143.

The vanes 410 and 420 may extend from the outer circumferential surface of the motor case 114 to the inner circumferential surface of the housing 200. In other words, the vanes 410 and 420 may extend to connect a surface of the connection passage 300, which has a large radius, to a surface of the connection passage 300, which has a small radius, with respect to the rotation shaft 120.

For example, the plurality of vanes 410 and 420 may be provided in plurality along a circumference of the motor case 114, and each of the vanes 410 and 420 may extend in a radial direction (upward and downward direction in FIG. 2). That is, the vanes 410 and 420 may extend in the radial direction with respect to the rotation shaft 120 to provide a wall in a partial space of the connection passage 300.

That is, the refrigerant passing through the connection passage 300 may be guided by the vanes 410 and 420 connecting the inner circumferential surface of the housing 200 to the outer circumferential surface of the motor case 114.

As a result, the flow direction of the refrigerant passing through the connection passage 300 may be guided along the forward and backward extending direction of the vanes 410 and 420.

The motor 110 and a plurality of electronic equipment may be installed in the accommodation space 113 of the motor case 114. However, according to an embodiment, since the connection passage 300 is provided to surround the motor case 114, it may be difficult to introduce a wire providing power to the motor 100 and the like into the accommodation space 113 of the motor case 114.

To solve this limitation, the vanes 410 and 420 may include wire holes 411 and 412 that connect the accommodation space 113 of the motor case 114 to an outer space of the housing 200.

Each of the wire holes 411 and 412 may be provided by allowing a hole having a predetermined diameter to extend in an extending direction, i.e., in a radial direction of the vanes 410 and 420.

Also, the wire holes 411 and 412 may allow the outside of the housing 200 to communicate with the accommodation space 113. Thus, the power may be supplied to the components disposed in the accommodation space 113.

The vanes 410 and 420 may include a first vane 410 and a second vane 420 which is disposed behind the first vane 410.

The first vane 410 and the second vane 420 may extend in an air-foil shape in the front-rear direction.

Also, a refrigerant F passing through the connection passage 300 may be guided first along a curved surface extending in the front-rear direction after colliding with the foremost edge of the first vane 410. Here, the foremost edge may be called a "leading edge".

The second vane 420 may be provided in a plurality that are spaced apart from each other in both circumferential directions with respect to a center of the rearmost edge of the first vane 410. Here, the rearmost edge may be referred to as a "trailing edge".

Thus, a refrigerant F flowing along the curved surface of the first vane 410 may leave the trailing edge of the first vane 410 to collide with the leading edge of the second vane 420. Also, the refrigerant F colliding with the second vane 420 may be guided backward along the curved surface extending in the front-rear direction of the second vane 420. Thus, the refrigerant F passing through the connection passage 300 may be reduced in the component that causes the swirl while sequentially passing through the first vane 410 and the second vane 420 and may relatively increase in a straight flow component.

The first vane 410 and the second vane 420 may be provided to be disposed in the connection channel 320. Since the discharge channel 310 and/or the inflow channel 330 have(has) an inclination in a horizontal line (or an extension line of the rotation axis) along the first case part 114*a* and the third case part 114*c*, the connection channel 320 may be more easily controlled in flow component of the refrigerant.

The first vane 410 and the plurality of second vanes 420 spaced apart from each other in the circumferential direction with respect to the trailing edge of the first vanes 410 may be defined in a pair. Also, the vanes 410 and 420, which are provided in the one pair, may be provided in plurality along the circumferential direction on the outer circumferential surface of the motor case 114.

The wire holes 411 and 412 may be provided in plurality. For example, the wire holes 411 and 412 may include a first wire hole 411 and a second wire hole 412, which have diameters different from each other.

The first wire hole 411 may have a diameter greater than that of the second wire hole 412 so that the plurality of wires are inserted into the accommodation space 113.

Also, the second wire hole 412 may be disposed to be spaced apart from the first wire hole 411. Thus, a user may select the wire holes 411 and 412 that are close to the components installed in the accommodation space 113 to insert the wires.

For example, the wire providing the power to the motor 110 may be inserted into the first wire hole 411, and the wire providing the power to sensors installed in the plurality of bearings 121, 122, and 125 may be inserted into the second wire hole 412.

The wire holes 411 and 312 may pass through the first vane 410 having a width or surface area greater than that of the second vane 420. Of course, the wire holes 411 and 412 may also be defined in the second vane 420.

Figure 5:
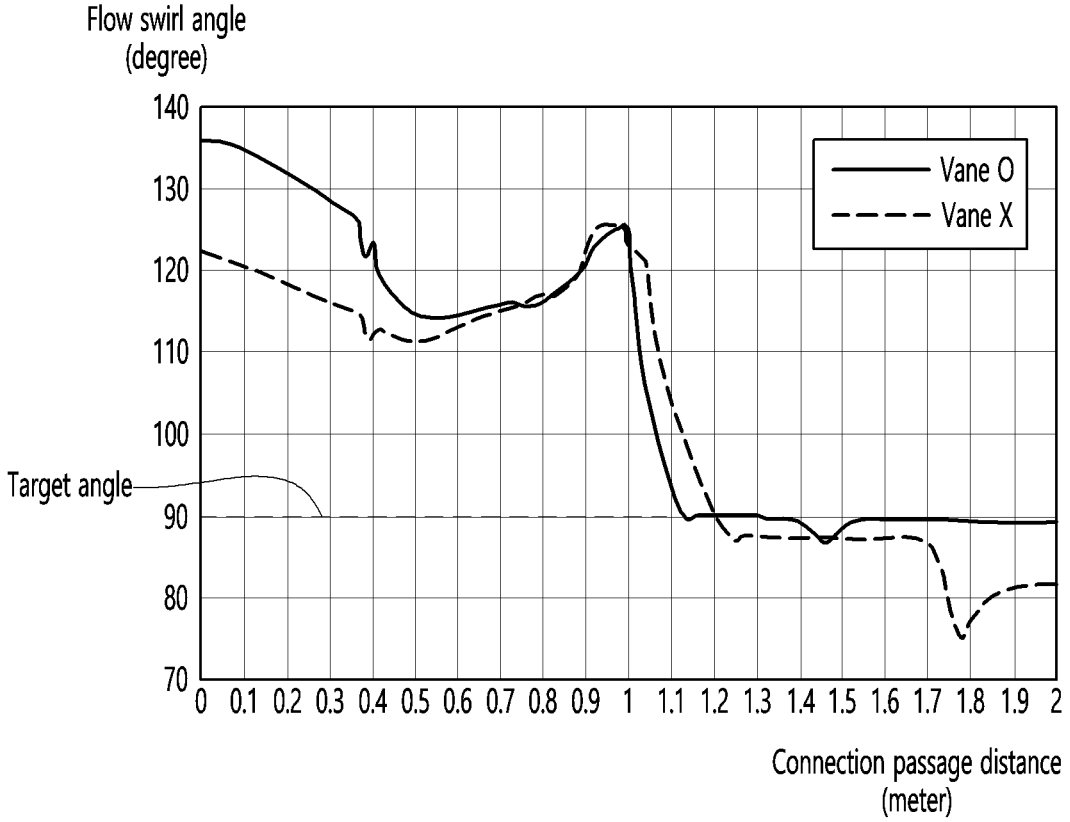
FIG. 5 is a graph illustrating results obtained by measuring swirl angles of the refrigerant depending on a distance from the turbo compressor to the connection passage according to an embodiment.

FIG. 5 is a graph illustrating results obtained by measuring swirl angles of the refrigerant depending on a distance from the turbo compressor to the connection passage according to an embodiment.

In detail, FIG. 5 illustrates an experimental graph that compares a case (solid line) in which the vanes 410 and 420 according to an embodiment are installed in the connection passage 300 to a case (dotted line) in which the vane is not installed.

In the experiment of FIG. 5, a distance of the connection passage 300, i.e., a distance between the outlet of the first impeller 141 and the inlet of the second impeller 143 is about 2 m, and an optimal target swirl angle at the inlet of the second impeller 143 is about 90 degrees.

Referring to FIG. 5, it may be confirmed that when the vanes 410 and 420 are installed, the swirl angle of the refrigerant passing through the connection passage 300 is maintained in a state closer to about 90 degrees than that when the vanes 410 and 420 are not installed, and thus, the refrigerant is introduced into the second impeller 143.

That is, since the refrigerant introduced into the second impeller 143 is introduced at an optimal swirl angle by the vanes 410 and 420, efficiency in the secondary compression may be further improved.

Hereinafter, an operation of the compressor 100 according to an embodiment will be schematically described.

First, the rotation shaft 120 may receive the driving force by the motor constituted by the stator 112 and the rotor 111 to rotate.

When the rotation shaft 120 rotates, primary compression of the refrigerant suctioned into the refrigerant suction hole 202 through the mixed flow type first impeller 141 connected to the front end of the rotation shaft 120 may be performed. Here, since the first impeller 141 is provided as the mixed flow impeller, the number of revolutions may increase, and the diameter may decrease compared to the existing centrifugal impeller.

The primarily compressed refrigerant may pass through the connection passage 300 provided to surround the motor case 114 and provided as the streamlined refrigerant passage toward the rear side and then be finally introduced into the centrifugal type second impeller 143.

The second impeller 143 may perform the secondary compression of the refrigerant and then discharge the refrigerant into the volute case 103. In addition, the compressed refrigerant may be introduced into the condenser 20 through the refrigerant discharge hole 104 defined in the mold case 103.

Therefore, the shape of the passage between the two impellers may be simplified compared to the case in which all the first impeller and the second impeller are provided as the centrifugal impellers to be disposed in series or symmetrical to each other, and also, a tube for providing a separate passage may not be required to reduce the size of the compressor 100.

In addition, since the vanes 410 and 420 capable of controlling the refrigerant flow component are installed in the connection passage 300, the swirl of the one-stage compressed refrigerant (gas) may be minimized at the inlet of the second impeller 143. That is, the refrigerant may be introduced at an optimal angle into the second impeller 143 to reduce the flow loss and improve the compression efficiency.

According to the embodiment, the impeller performing the initial compression (the one-stage compression) may be provided as the mixed flow impeller to reduce the size of the impeller while maintaining the compression performance. That is, the turbo compressor may be compact.

According to the embodiment, since the mixed flow impeller that perform the one-stage compression, increases in specific speed compared to the centrifugal impeller according to the related art, the impeller may increase in number of revolutions and decrease in diameter.

According to the embodiment, since the mixed flow impeller that performs the one-stage compression is provided, the pressure loss or flow loss of the refrigerant may be reduced compared to the turbo compressor including the two centrifugal impellers in which the refrigerant is discharged in the radial direction and introduced in the axial direction, due to the flow direction of the refrigerant discharged from the mixed flow impeller.

According to the embodiment, due to the direction of the refrigerant discharged from the mixed flow impeller, since the flow space ("the connection passage") of the refrigerant up to the impeller that performs the second compression (the two-stage compression) is defined to surround the outer circumferential surface of the motor, the pressure loss and flow loss of the refrigerant, which occur in the multi-stage compression process in the turbo compressor according to the related art may be reduced, and the turbo compressor may be minimized in size.

According to the embodiment, the economizer may be provided to improve the efficiency of multi-stage compression, and the gas discharged from the economizer may be supplied to the outlet of the mixed flow impeller, through which the refrigerant compressed in one stage is discharged, to reduce the flow loss and improve the efficiency of the turbo chiller.

According to the embodiment, the two impellers spaced apart from each other with respect to the motor are disposed (disposed in series to be spaced apart from each other) so that the outlets, through which the refrigerant is discharged, are directed in the same direction, and the connection passage connecting the two impellers to each other may guide the refrigerant in the relatively straight direction to reduce the flow loss.

According to the embodiment, since the vane that guides the flow direction of the refrigerant is disposed in the connection passage connecting the two impellers to each other, the refrigerant that is compressed in one stage may reduce the swirl of the flow while passing through the connection passage. Therefore, the refrigerant that is minimized in swirl may be introduced into the inlet of the impeller for performing the two-stage compression to improve the compression efficiency.

According to the embodiment, the mixed flow impeller for the one-stage compression may be provided to increase in rotation rate, and the impeller may increase in diameter by about 12% to about 19% compared to the existing centrifugal impeller.

According to the embodiment, the loss of the refrigerant passing through the connection passage may be reduced by about ⅓ level than the series continuous arrangement or symmetrical arrangement according to the related art.

According to the embodiment, since the connection passage is provided along the outer circumferential surface of the motor, the phenomenon in which the dew generated in the motor casing (or motor housing) is formed when cooling the motor according to the related art may be prevented.

According to the embodiment, the specific speed range may increase by about 1.8, and the diameter may be reduced by the mixed flow impeller for the one-stage compression.

According to the embodiment, the number of components may be reduced, and the manufacturing cost of the product may be lowered. That is, the economics of the product may be improved.

According to the embodiment, the surge phenomenon that occurs in the multi-stage impeller may be prevented to improve the operational reliability of the turbo chiller.

According to the embodiment, since the structure of the passage connecting the two impellers to each other is relatively simple and straightened, the pressure loss of the refrigerant may be minimized.

According to the embodiment, the inflow angle of the refrigerant may be optimized by the vane of the connection passage at the inlet of the impeller for the two-stage compression. As a result, the flow loss of the refrigerant may be minimized.

According to the embodiment, since the structure of the turbo compressor is simplified, the turbo compressor may be easily managed and be reduced in risk of the failure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A turbo compressor comprising:

a housing having a refrigerant suction hole, through which a refrigerant is configured to be introduced, at a front portion thereof;

a motor case defining an accommodation space including:
a rotation shaft extending in a front-rear direction; and
a motor configured rotate the rotation shaft;
a first impeller coupled to a first end of the rotation shaft, the first impeller being configured to compress the refrigerant introduced into the refrigerant suction hole;
a connection passage extending backward from an outlet of the first impeller, the connection passage surrounding the motor case;
a vane installed in the connection passage to guide a flow of the refrigerant; and
a second impeller coupled to a second end of the rotation shaft, the second impeller being configured to compress the refrigerant introduced through the connection passage,
wherein the vane comprises:
a first vane; and
a plurality of second vanes disposed behind the first vane,
wherein each of the first vane and the plurality of second vanes has an air-foil shape in the front-rear direction, and
wherein the plurality of second vanes are spaced apart from each other in a circumferential direction with respect to a trailing edge of the first vane.

2. The turbo compressor according to claim 1, wherein the motor case is spaced inward from the housing, and
wherein the connection passage is provided in a space between the housing and the motor case.

3. The turbo compressor according to claim 1, wherein the motor case is surrounded by the housing.

4. The turbo compressor according to claim 1, wherein the connection passage is provided in a space defined between an inner circumferential surface of the housing and an outer circumferential surface of the motor case.

5. The turbo compressor according to claim 1, wherein the first impeller and the second impeller are disposed at front and rear sides of the motor, respectively.

6. The turbo compressor according to claim 1, wherein the outlet of the first impeller and an outlet of the second impeller face the same direction, and
wherein the first impeller and the second impeller are spaced apart from each other in the front-rear direction and fluidly connected together by the connection passage.

7. The turbo compressor according to claim 1, wherein the first impeller is a mixed flow impeller.

8. The turbo compressor according to claim 7, wherein the second impeller is a centrifugal impeller and includes a diameter range equal to that of the first impeller.

9. The turbo compressor according to claim 1, wherein the vane extends from an outer circumferential surface of the motor case to an inner circumferential surface of the housing.

10. The turbo compressor according to claim 9, wherein the vane comprises:
a wire hole through which the accommodation space of the motor case and the outside of the housing communicate with each other, and
a wire, configured to provide power, provided in the wire hole.

11. The turbo compressor according to claim 1, further comprising a bearing and a thrust bearing, which are configured to support rotation of the rotation shaft,
wherein the bearing comprises a first bearing and a second bearing spaced apart from each other in the front-rear direction.

12. The turbo compressor according to claim 11, wherein the thrust bearing is disposed between the first bearing and the first impeller.

13. The turbo compressor according to claim 11, wherein the motor comprises a permanent magnet motor, and
wherein the bearing comprises a magnetic bearing configured to support the rotation shaft by using magnetic force.

14. The turbo compressor according to claim 1, wherein the connection passage comprises:
a discharge channel configured to guide the refrigerant discharged from the first impeller, the discharge channel having a diameter that increases in a rearward direction from the outlet of the first impeller;
a connection channel having a constant diameter extending in the rearward direction from the discharge channel; and
an inflow channel, having a decreasing diameter, extending in the rearward direction from the connection channel, the inflow channel being configured to guide the refrigerant to the second impeller.

15. The turbo compressor according to claim 1, further comprising a volute case coupled to a rear end of the housing and having a refrigerant discharge hole,
wherein the refrigerant passing through the second impeller is introduced into the refrigerant discharge hole.

16. A turbo chiller comprising:
a turbo compressor;
a condenser configured to exchange heat between a refrigerant compressed in the turbo compressor and cooling water;
an expansion valve configured to expand the refrigerant passing through the condenser; and
an evaporator configured to evaporate the refrigerant passing through the expansion valve and provide the expanded refrigerant to the turbo compressor,
wherein the turbo compressor includes:
a housing having a refrigerant suction hole, through which the refrigerant is configured to be introduced, at a front portion thereof;
a motor case defining an accommodation space including:
a rotation shaft extending in a front-rear direction; and
a motor configured to rotate the rotation shaft;
a first impeller coupled to a first end of the rotation shaft, the first impeller being configured to compress the refrigerant introduced into the refrigerant suction hole;
a connection passage extending backward from an outlet of the first impeller, the connection passage surrounding the motor case;
a vane installed in the connection passage to guide a flow of the refrigerant; and
a second impeller coupled to a second end of the rotation shaft, the second impeller being configured to compress the refrigerant introduced through the connection passage,
wherein the vane comprises:
a first vane; and
a plurality of second vanes disposed behind the first vane,
wherein each of the first vane and the plurality of second vanes has an air-foil shape in the front-rear direction, and wherein the plurality of second vanes are spaced apart from each other in a circumferential direction with respect to a trailing edge of the first vane.

17. The turbo chiller according to claim 16, further comprising:

an economizer installed between the expansion valve and the evaporator; and an injection tube through which the refrigerant from the economizer flows, wherein the turbo compressor comprises:

an injection tube connection passage configured to fluidly communicate with the injection tube; and an injection hole defined in the housing such that the injection tube connection passage and the connection passage fluidly communicate with each other.

* * * * *